United States Patent [19]

Bruno

[11] Patent Number: 4,704,845

[45] Date of Patent: Nov. 10, 1987

[54] METHOD AND APPARATUS FOR CLOSING BAGS AND A PLANT FOR BAGGING BULK MATERIALS

[75] Inventor: Gmur Bruno, St. Gallen, Switzerland

[73] Assignee: Gebruder Buhler AG, Uzwil, Switzerland

[21] Appl. No.: 862,183

[22] Filed: May 8, 1986

Related U.S. Application Data

[63] Continuation of Ser. No. 537,273, Sep. 29, 1983, abandoned.

[30] Foreign Application Priority Data

Oct. 16, 1982 [CH] Switzerland ..... 6013/82

[51] Int. Cl.[4] ..... B65B 7/08

[52] U.S. Cl. ..... 53/482; 53/481; 53/371; 53/378

[58] Field of Search ..... 53/271, 273, 371, 378, 53/379, 482, 139, 267, 289, 300, 368, 285, 374, 381 R, 384, 481, 418; 198/339.1, 592, 341, 861.1, 586, 861.5

[56] References Cited

U.S. PATENT DOCUMENTS

| | | | |
|---|---|---|---|
| 2,757,894 | 8/1956 | Kindseth | 53/418 X |
| 2,911,778 | 11/1959 | Ozor | 53/481 X |
| 2,925,699 | 2/1960 | Ozor . | |
| 3,115,736 | 12/1936 | Peterson | 53/371 |
| 3,241,290 | 3/1966 | Ingleson et al. | 53/371 |
| 3,483,803 | 12/1969 | Back et al. | 53/374 X |
| 3,755,986 | 9/1983 | Hudson | 53/378 |
| 3,775,937 | 12/1973 | Devan et al. | 53/374 X |
| 3,805,489 | 4/1974 | Lieder et al. | 53/378 |
| 3,882,657 | 5/1975 | Fischbein et al. | 198/341 X |
| 3,928,114 | 12/1975 | Aylon | 198/341 X |
| 4,069,646 | 1/1978 | Slomp et al. | 53/371 X |
| 4,162,602 | 7/1979 | Achelpohl et al. | 53/138 A |
| 4,284,187 | 8/1981 | Kramer et al. | 198/592 X |
| 4,322,932 | 4/1982 | McGregor | 53/371 X |
| 4,418,513 | 12/1983 | Plahm | 53/481 X |

FOREIGN PATENT DOCUMENTS

| | | | |
|---|---|---|---|
| 2408416 | 8/1974 | Fed. Rep. of Germany | 53/368 |
| 2931571 | 2/1981 | Fed. Rep. of Germany | 53/368 |
| 1122481 | 9/1956 | France | 53/384 |
| 2038763 | 7/1980 | United Kingdom | 53/371 |
| 2067462 | 7/1981 | United Kingdom | 53/285 |

*Primary Examiner*—Robert L. Spruill
*Assistant Examiner*—Steven P. Weihrouch
*Attorney, Agent, or Firm*—Merchant, Gould, Smith, Edell, Welter & Schmidt

[57] ABSTRACT

The process serves for closing filled bags (52) making use of an approximately horizontal conveying track (3). The bags are fed on a conveying track with constant conveying speed to a spreading apparatus (16 to 51) and then to a closing station (12, 13). In order that the bag material be stressed as little as possible in the case of a greater capacity, provision is made for a movement to be superimposed on the spreading tools (21) of the spreading apparatus during the spreading process, in the conveying direction (4), that attains the conveying speed, at latest, at the end of the spreading process. In this fashion, the bag end is spread apart without the bag experiencing a delay by the spreading tools (21) reaching therein.

10 Claims, 14 Drawing Figures

METHOD AND APPARATUS FOR CLOSING BAGS AND A PLANT FOR BAGGING BULK MATERIALS

This is a continuation of application Ser. No. 537,273, filed Sept. 29, 1983, now abandoned.

TECHNICAL FIELD

The invention concerns a method for closing bags of various sizes through means of a closing station which, with its tools, is associated with a continuous conveyor that is adjustable in inclination for adapting in height to the various sizes of bags and that discharges, at intervals, in a closed condition, without free-fall, bags that arrive in the open condition from a bagging station.

BACKGROUND AND SUMMARY OF INVENTION

Automation, at least from the point of view of the plant construction firm, can be seen as a contest of questions on strength of materials on the one hand, and, on the other hand, the rapidity of the progression of movement. In the present case, however, direct influence can be applied only to one part of the plant elements. For example, practically no influence can be exerted on bag materials in the realm of the food and feed industry, since these (bag materials) are essentially specified by the market. A stronger paper quality results practically automatically in greater expenditures for the clients, since we are dealing with mass goods, and savings by further increasing automation is questionable. A further central problem in the case of automation of the bagging process lies with the bag itself.

In contrast to piece goods, such as boxes or finished products, such as chocolates or automobile components, a bag, particularly in the filled condition, offers a constant external form and external dimensions only within wide limits. Another problem is a certain disproportionality between the plant elements, consisting today principally of steel, and the bag material which may be paper, plastic or textile fabric. Anyone who has carried around by hand paper or plastic bags weighing from 30–50 kg or more already consciously recognizes the problem of the relationship: weight of the bag and strength of the bag jacket. It is further a fact from experience that sources of disturbance can be eliminated almost without effort by manual intervention in the case of semi-automatic plants, this by means of a slight straightening up of the bag, better raising the bag, orderly preparation of the open end of a filled paper bag, etc. Any average person possesses, in this respect, a broadly considered sense concerning any technique. The semi-automatic filling of bags, however, is rejected by many since there is quite often associated with this still considerable physical exertion, and this on a schedule that is dictated by the machine. This applies particularly if the bags display 50 kg and more. Here also, within the scope of solutions known up until now, automation has a "natural" upper limit.

The invention would also provide as a partial task improvement in the manipulation of bags for bagging and closing the transport bags.

In the case of one known state of the art solution, the problem of closing bags of different heights is resolved by the fact that the continuous conveyor, most often an endless conveyor belt about a point of rotation, is adaptable in raisable and lowerable fashion on the delivery side, respectively on the loading side, to the various bag heights. Hence, free-fall of the bag can be prevented at both transfer points. This solution has proven itself in practice. In particular, balancing mechanisms and other sources of disturbance can be avoided in this fashion.

Therefore, also one of the principal tasks of the invention, in the case of solutions with continuous conveyors and/or conveyor belts that are adjustable in inclination, therefore also without free-fall of the bags and/or corresponding auxiliary means for avoiding same, was to close the bags in trouble-free fashion and cleanly, e.g. to stitch cleanly. The solution in accordance with the invention is characterized by the fact that the movements of the closing tools are initiated harmoniously in synchronism with the movement of the bag and/or its range of opening.

The task has been resolved by the fact that the individual phases of the closure operation are carried out harmoniously with the conveying movement of the bags on a continuously running conveyor belt.

With the knowledge from the invention, the previous path to automation of bag closure can now, looking back, be judged as a false path. Up to certain limits, using the so-called "speed trick", movements running counter to each other can be coupled together, provided at least that one of the movements is executed sufficiently slowly and the other movement sufficiently rapidly. The logic alone included in this leads to a natural limit of increasing speed.

The invention further permits various advantageous other embodiments. In a particularly preferred solution, the spreading tools execute, during the spreading movement, a movement that follows the range of bag opening. It is precisely through the second movement of the means for spreading the open, top end of a freshly filled bag, superimposed and added to the first movement of the transport motion, that the spreading movement can now be carried out more slowly. In spite of an increase of the overall speed run, this leads to a much slower, more careful and, therewith, more guarded spreading movement of the bag end.

It is particularly advantageous if the spreading tools are moved, during the spreading movement, on the average, with the same speed and in the same direction as the open bag ends. The importance of this in itself simple procedure in accordance with the invention is recognized by the fact that the bag can be stitched only as well as it has been prepared for this. Spreading of the bag end, present in round or oval form after filling, into a corresponding, long flat form for the sewing machine, is the preparatory step for stitching and, therewith, for the positive and orderly closure of the bag for all further manipulations, particularly for subsequent transport loading. The same would also apply in the case of gluing.

A slow movement always had the advantage of being able to be determined optically and also to be corrected in practice. It is further particularly advantageous if the movement is carried out by means of pneumatically driven spreading tools. The pneumatic pressure can be set to a predetermined maximum pressure. Hence, it requires no stop. Hence, tolerances in opening width of the bag plays no role in the slow movement. The spreading tool always adapts itself.

The idea of the invention can be applied in particularly elegant fashion with the measure already being used by the applicant, by adjusting the inclination of the belt such that variations in the height of the bag are compensated by corresponding one-sided adjustment in height of the receiving side of the belt, with a slight rotational movement being executed about an axis in the region of discharge from the belt.

BRIEF DESCRIPTION OF DRAWINGS

A further, particularly advantageous idea for embodiment in cooperation with adjustment of the inclination of the belt lies in the fact that the closure station as a whole is logically adjusted to the angle, respectively the change in support, of the conveyor belt.

DETAILED DESCRIPTION

Figure 1:
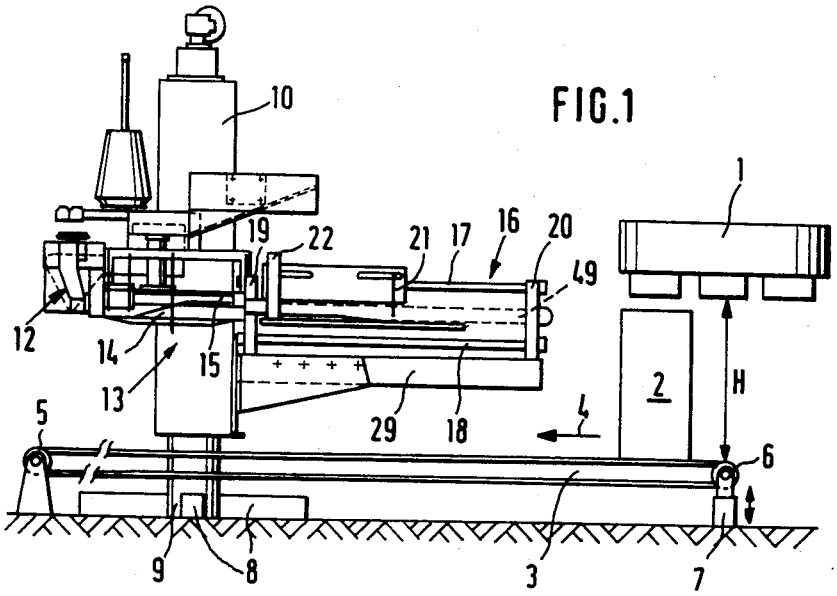

Particularly this last mentioned idea, together with the one mentioned previously, results in a particularly harmonious run-off, so that the entire working cycle runs off actually more harmoniously and, therefore, essentially more disturbance-free. Manual interventions become necessary only in exceptional cases. Therefore, in spite of the possibility of increasing operating capacity, there is a much lesser damage rate (defective bags), and a lesser employment of humans than previously necessary. As will be shown in the following, there are no essential, constructional added expenditures necessary for concrete realization of the invention.

The invention further concerns a plant for bagging bulk materials, in particular foods and feeds, with a bagging carousel, a conveying track adjustable in height in the region of the bagging carousel adjacent thereto, a spreading apparatus associated to the conveying track, and a folding mechanism with a following stitching or gluing station, characterized by the fact that the spreading station and/or the folding and stitching station are structured as movement and/or work runs associated harmoniously to the conveying track.

The present invention further relates to an apparatus for placing the bag walls parallel to one another at the top, open ends of filled bags, with a continuously driven conveying track forming a conveying path to which the bags are transferred at a progressive rate, and with two spreading fingers, actuated by a spreading drive, that can be moved, by driving means from above, into the open bag ends and, after completion of spreading, moved upwardly back out again.

In one known apparatus of this type, the spreading fingers supported on a frame-like carrying element are moved, additionally to the spreading movement, on a closed path such that, during the spreading movement, the spreading fingers run concurrently in the conveying direction of the conveying track on an arcuate curve segment. In this known apparatus, the concurrent movement is short enough so that the spreading movement must be carried out rapidly so that the bag to be closed, being conducted to the spreading apparatus with equal speed on the conveying track, does not remain suspended on the spreading fingers and pulled into a diagonal position. Because, a diagonal fold would be applied to a bag standing diagonally on the conveying track, which can lead to an incomplete closing stitch, i.e. to a partially open bag. This rapid closure movement of the top end of the bag required for avoiding this disadvantage occasions a strong development of dust, in particular if in the case of the bulk goods we are dealing with a powdery product.

The present invention sets for itself the task to improve an apparatus of the type mentioned such that closure of the top end of the bag is accomplished with lesser development of dust with a comparatively higher speed of the conveying track (which in the case of a high capacity of the bagging carousel is necessary).

This task is resolved in accordance with the invention by the fact that there is journaled, parallel to the conveying track, a carrying element capable of being displaced to and fro, that the spreading fingers are supported with the spreading drive at the carrying element, that further arranged at the carrying element are the driving means for moving the spreading fingers up and down relative to the carrying element, that the spreading drive exerts a spreading movement with a movement of the carrying element in the conveying direction and that the carrying element, at least upon reaching the end of the spreading movement of the spreading fingers, is driven, at least approximately, at the same speed as the conveying track. By means of the invention, the spreading movement, even in the case of the increased conveying speed being strived for today, can be accomplished slowly enough so that development of dust is very slight even when bagging powdery products.

According to a preferred form of embodiment, provided for is that the carrying element is journaled in to and fro displaceable fashion on a guide parallel to the conveying track. This form of embodiment has the advantage that the concurrently running stretch of path and, therewith, the time available for the spreading movement can be selected.

According to another preferred form of embodiment, provided for is that a bearing housing is hinged to the carrying element on an axis parallel to the guide, that the spreading fingers are journaled on the bearing housing by means of a spreading drive, and that the bearing housing is pivotable, by means of a pivoting drive from a position of the spreading fingers essentially perpendicular to the conveying track into a raised position in which the spreading fingers lie outside the conveying path of the bags. If, in so doing, a suction air line, ending with a suction hopper immediately over the spreading fingers and directed against this latter, is connected to the bearing housing, then the slight amount of dust precipitating when closing the bags will also be captured at the source and sucked out, whereby, even in the case of highest bagging speed, any development of dust is practically, completely suppressed. Another advantage consists in the fact that the dust captured and sucked out at the source has no possibility of depositing itself on the mechanical parts actuating the spreading fingers, whereby the usual, frequent cleaning of these parts, today, is eliminated.

The present invention further relates to a plant for bagging bulk material, with a bagging carousel, a conveying track adjustable in height in the region of the bagging carousel adjacent thereto, on which is arranged a spreading apparatus capable of moving to and fro in the conveying direction of the conveying track and a folding mechanism with a following stitching or gluing station.

In order to be able to adapt the height of the conveying track at the bagging carousel to the depth of the bags to be filled, it is known how to pivotably journal the conveying track at its discharge end and how to construct it at its inlet end to be height-adjustable in the region of the bagging carousel. This plant has the disadvantage that the direction of conveying of the conveying track is not necessarily oriented parallel to the direction of action of the folding mechanism. Capable of resulting from this are diagonal closure folds and no closing stitches parallel to the closure fold at the following gluing or stitching station.

The present invention sets for itself the further task to improve a plant of the initially mentioned type such that the direction of action of the folding mechanism is continuously oriented parallel to the conveying track that is adjustable in its inclination.

According to the invention, this task is resolved by the fact that the to and fro movement of the spreading apparatus, as well as the direction of action of the folding mechanism, are capable of being aligned parallel to the conveying track.

Figure 2:
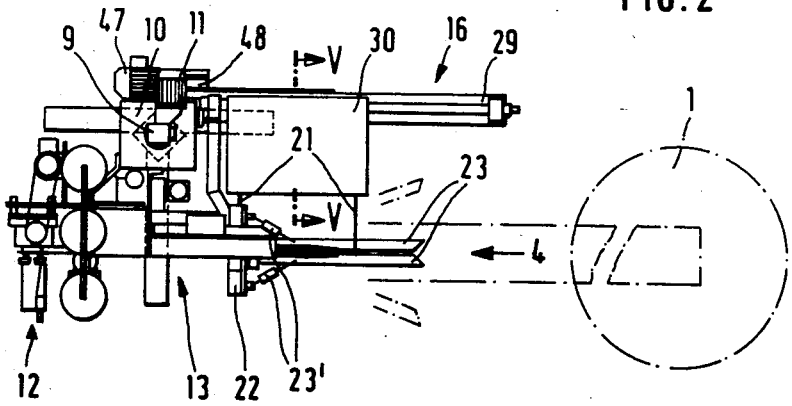
Figure 3:
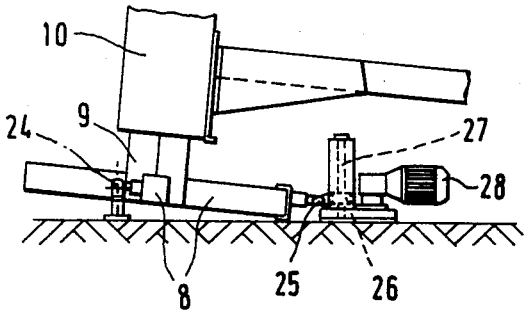
Figure 4:
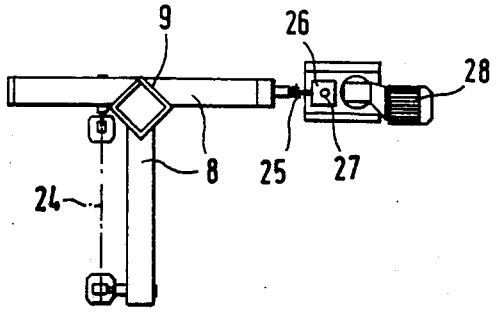
Figure 5:
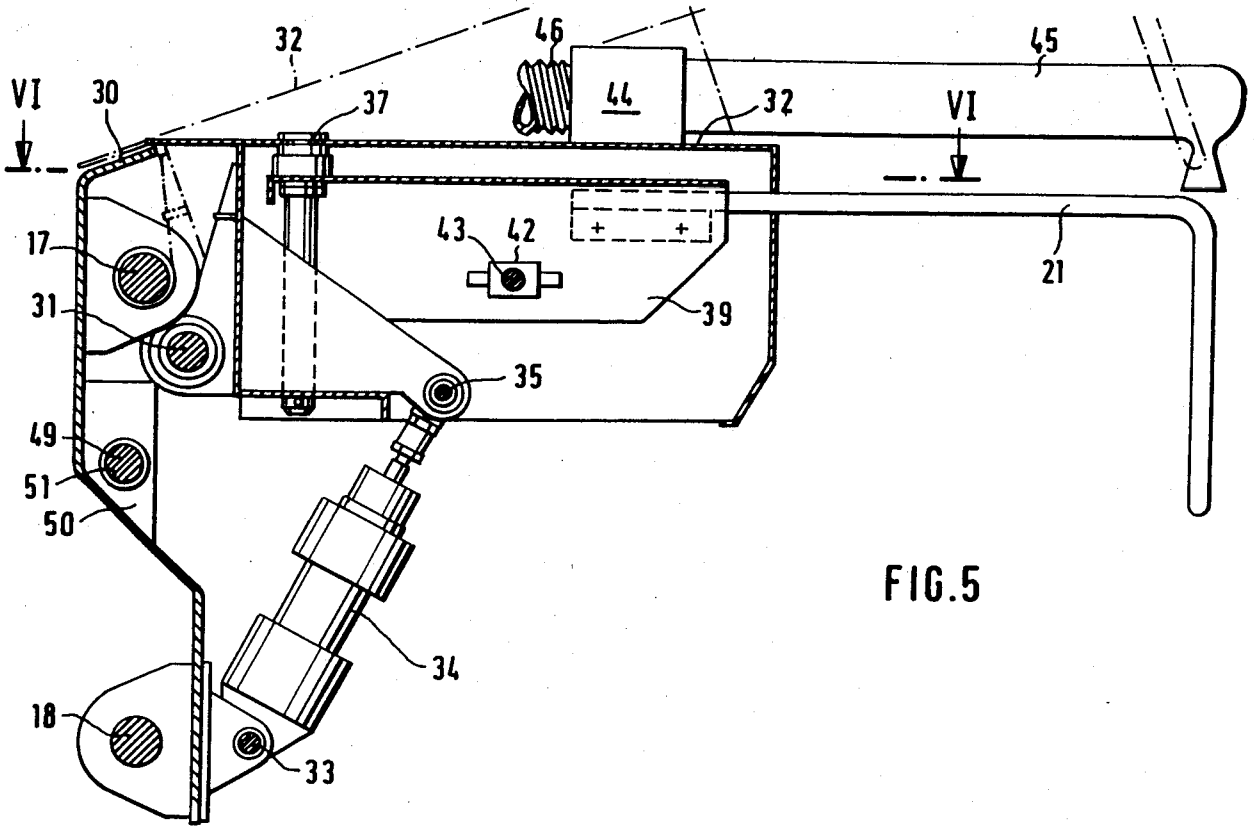
Figure 6:
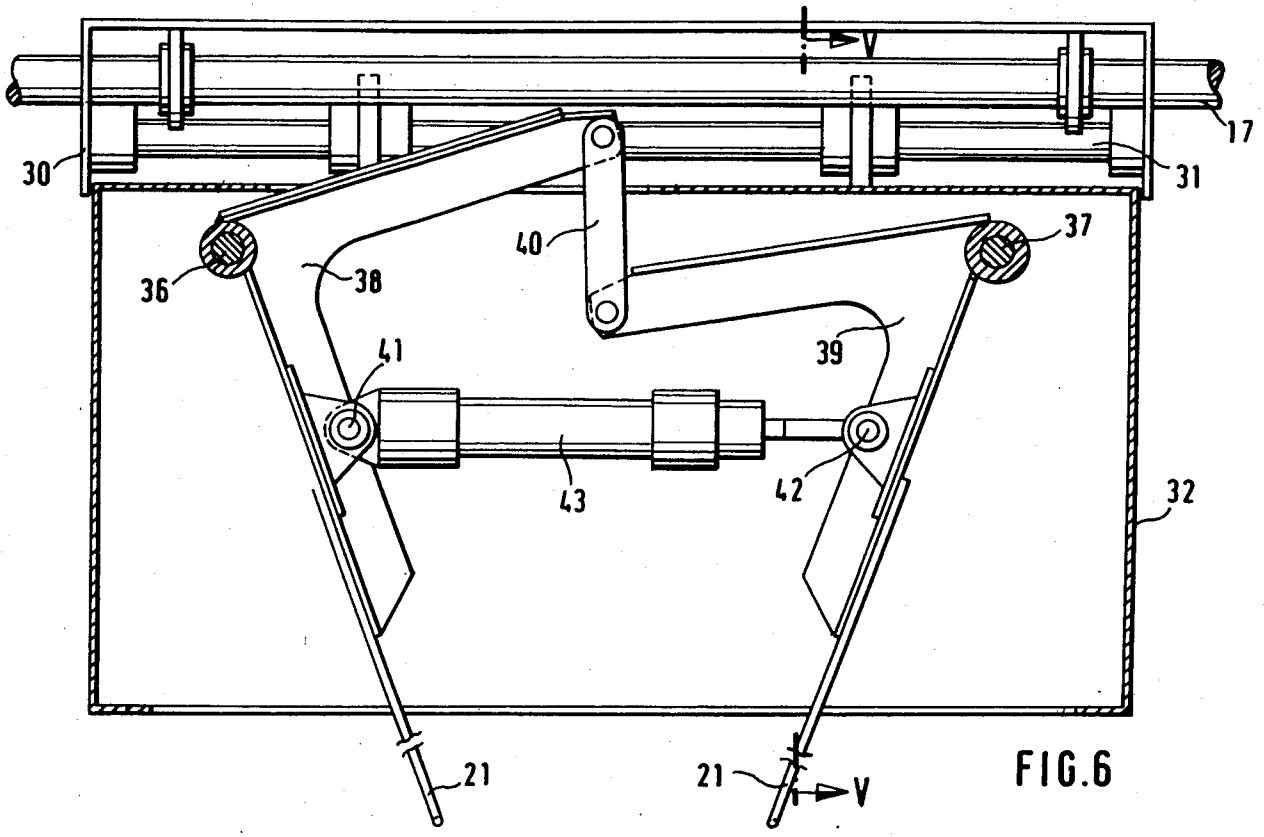

The invention will be explained, as an example, with the aid of the accompanying schematic drawing. Shown are:

FIG. 1 a view of a plant for bagging bulk materials,

FIG. 2 a view from above onto FIG. 1,

FIG. 3 an illustration the same as in FIG. 1, sectionally with a variant, FIG. 4 a view from above onto FIG. 3, FIG. 5 a cut along line V—V in FIG. 2 and 6, FIG. 6 a cut along line VI—VI in FIG. 5, FIG. 7, 9, 11 and 13 a section from FIG. 1 in simplified illustration, in different phases of operation and FIG. 8, 10, 12 and 14 each a view from above onto the figure preceding each one.

FIG. 1 and 2 show a plant for bagging bulk materials. They display a bagging carousel 1 from which the filled bags 2 are placed onto a conveying track 3 and transported away therefrom in the direction of conveying (arrow 4). The conveying track 3 is constructed as an endless conveying belt that is pivotable about the rotating axle 5 of its discharge end guide roller. The guide roller at the receiving location is journaled, with its rotating axle 6 vertically adjustable, in a bearing 7 that can be embodied in cart-raising fashion. The distance H from the conveying track 3 to the bagging carousel 1 can be adapted by means of the height adjustment capability to the height of the bag to be filled in such fashion that the drop height of the bags can be maintained constant and as small as possible.

Installed at the conveying track by means of a tripod 8 is a column 9 on which is supported in vertically displaceable fashion a jacket 10 and capable of being driven by means of a motor 11 and a trapezoidal threading that is not visible. The jacket 10 can be adjusted in its vertical position along the column 9 by means of the motor 11.

Connected at the jacket 10 is a commercial type stitching mechanism 12 that stitches the bags passing by closed at the top end. Since the special embodiment of this type of stitching mechanism has no influence on the present invention, its description will be eliminated.

Additionally attached to the jacket 10 is a folding mechanism 13 with the folding bars 14 and 15, with the top folding edge of the folding bar 14 determining the direction of action of the folding mechanism 13, i.e. the folding line. As seen in the direction of conveying 4 of the conveying track 3, the folding mechanism 13 lies ahead of the stitching mechanism 12. Like the stitching mechanism 12, it also is a known assembly and, relative to its construction, has no influence on the present invention.

Additionally attached to the jacket 10 is a carrier 29 and, thereon, a frame 16 that consists of two longitudinal guides 17 and 18 and two vertical struts 19 and 20. Supported in to and fro displaceable fashion in the direction of conveying (arrow 4) of the conveying track 3, on the longitudinal guides 17 and 18, is a carrying element for the spreading fingers 21, in the form of a slide 30.

Additionally attached on the vertical strut 19 of the frame 16 is a carrying arm 22 on which are pivoted two closing bars 23. The closing bars 23 are actuated by pneumatic cylinder 23' and are pivotable between the position sketched with solid lines on one end and the position sketched with dash-dot lines on the other end.

As shown in FIG. 3 and 4, the tripod 8 of column 9 can be pivotably journaled about a horizontal axis 24 oriented transversely to the conveying direction (arrow 4) of the conveying track 3, and be articulated in height adjustable fashion at 25 on a motor driven spindle 27, at the main body 26. Through connection of a motor 28, the spindle 27 can be rotated and the inclination of the column 9 changed such that the direction of action of the folding mechanism (angle of inclination of the folding edge of the folding bar 17 with reference to a horizontal plane) changes. Hence, by rotation of the spindle 27, the folding mechanism 13 can be continuously adjusted on a folding line parallel to the conveying track 3 whenever the angle of inclination of the conveying track is changed.

In accordance with FIG. 5 and 6, arranged in the slide 30, parallel to the longitudinal guides 17 and 18, is a pivot axle 31 on which is articulated a bearing housing 32. Additionally articulated to the slide 30, at 33, is a pneumatic cylinder piston unit 34, the piston rod of which is joined with the bearing housing 32 in pivoting fashion at 35. If the piston rod of the cylinder piston unit 34 is extended, the bearing housing 32 will be pivoted out from the position shown with solid lines, in which the downwardly bent ends of the spreading fingers 21 are in a vertical plane, upwardly into the position indicated with dash-dot lines. When the piston rod is retracted, there follows a reverse downwardly pivoting movement.

Firmly arranged in the slide 30 are two pivot axles 36 and 37, about which are pivotably journaled angle levers 38 and 39. The arms of angle lever 38 and 39 facing each other are joined together with a link member 40, with, on the other hand, the other arms at 41 and 42 being respectively articulated at the ends of a pneumatic cylinder piston unit. Further attached to each of the arms of the angle levers 38 and 39 that are joined together through the cylinder piston unit 43 is a spreading finger 21. If the piston rod of the cylinder piston unit 43 is extended, the angle levers 38, 39, occasioned by the link member 40, pivot symmetrically outwardly into the position shown in dash-dot lines and complete a spreading movement. When the piston rod of the cylinder piston unit 43 is retracted, the spreading fingers 21 are moved toward one another.

As shown in FIG. 5, a suction tube 45, which ends over the downwardly directed ends of the spreading fingers 21 and expands toward these latter in hopper fashion, is attached to the bearing housing 32 by means of a tubular clamping collar 44. Connected to the suction tube 45 is an armored folding hose 46 that leads to a non-illustrated source of suction air. Due to the fact that the suction tube 45 is firmly joined with the bearing housing 32, suctioning of dust always takes place in the immediate vicinity of the spreading fingers 21 and, therewith, during a spreading process, immediately over the open bag end, i.e. at the place of development of dust.

Provided for the to and fro movement of the slide 30 is a motor 47 (FIG. 2) that drives a spindle 49 (FIG. 5) via a transmission 48 that runs parallel to the longitudinal guides 17 and 18 and that is supported on the slide in a threaded boring. Also capable of being provided as a drive element in place of spindle 49 is an endless chain. Depending upon the direction of rotation of the motor 47, the slide 30 will be moved in the conveying direction of the conveying track (arrow 4, FIG. 1) or in the direction opposite to this.

Figure 7:
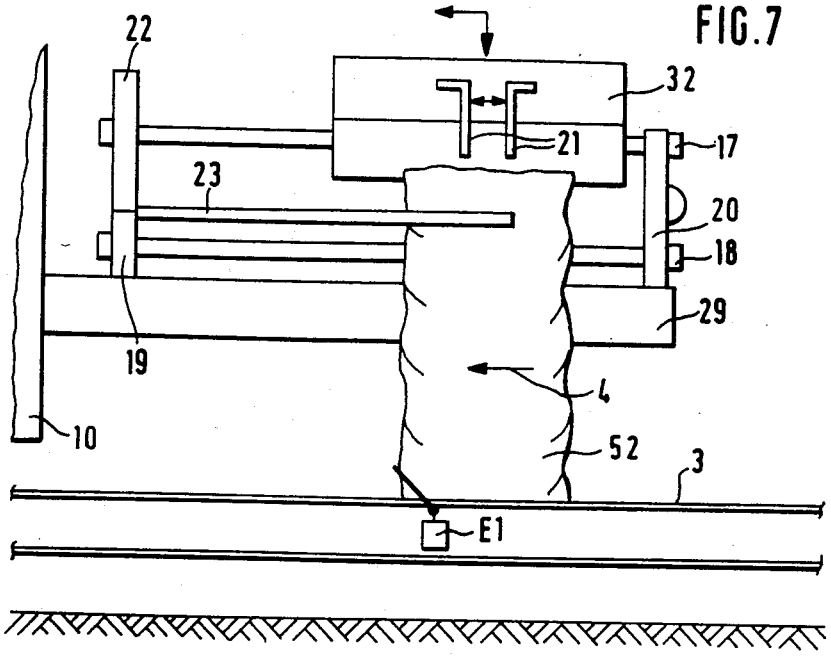
Figure 8:
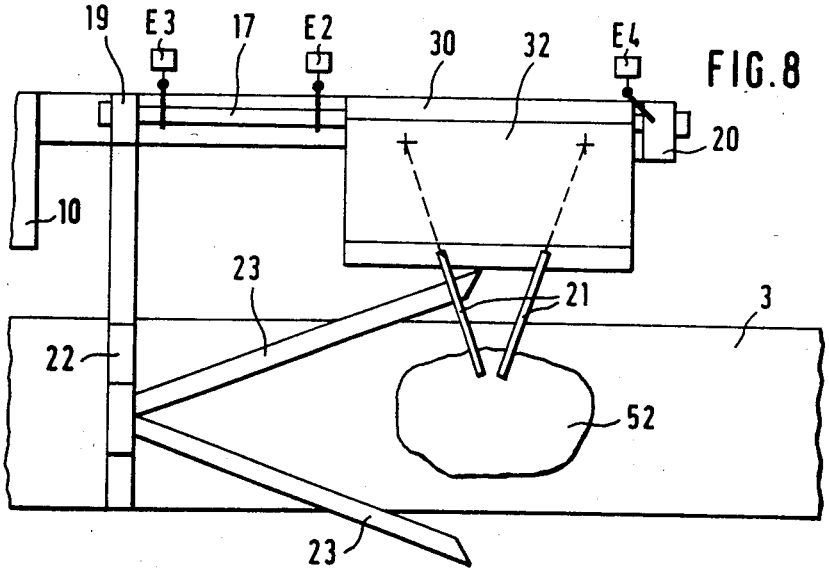
Figure 9:
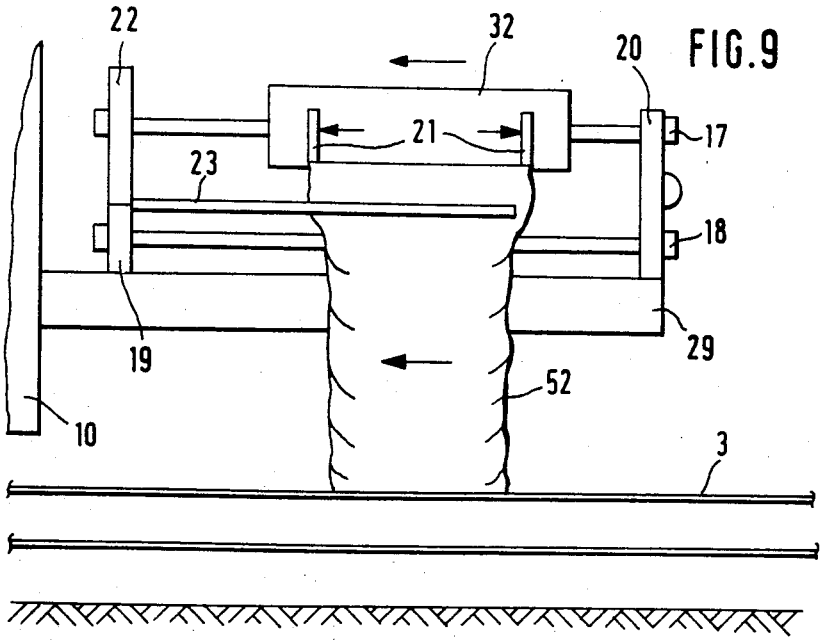
Figure 10:
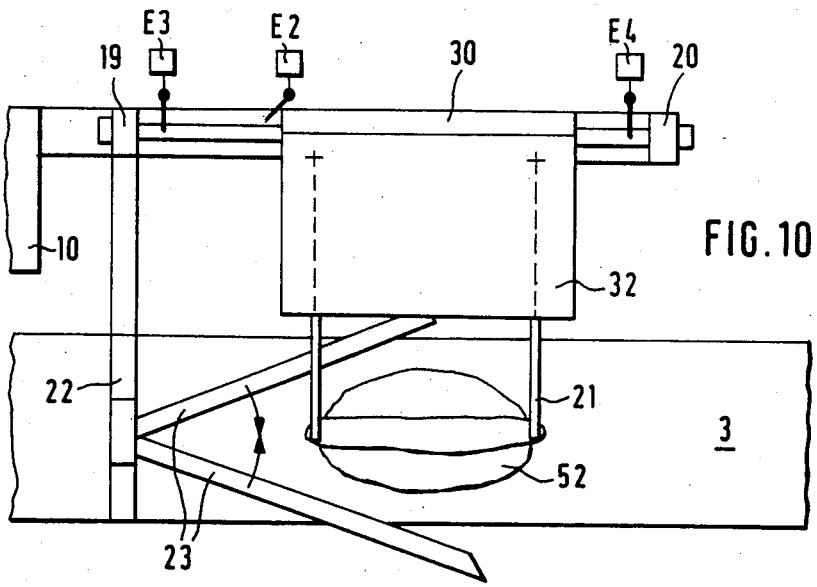
Figure 11:
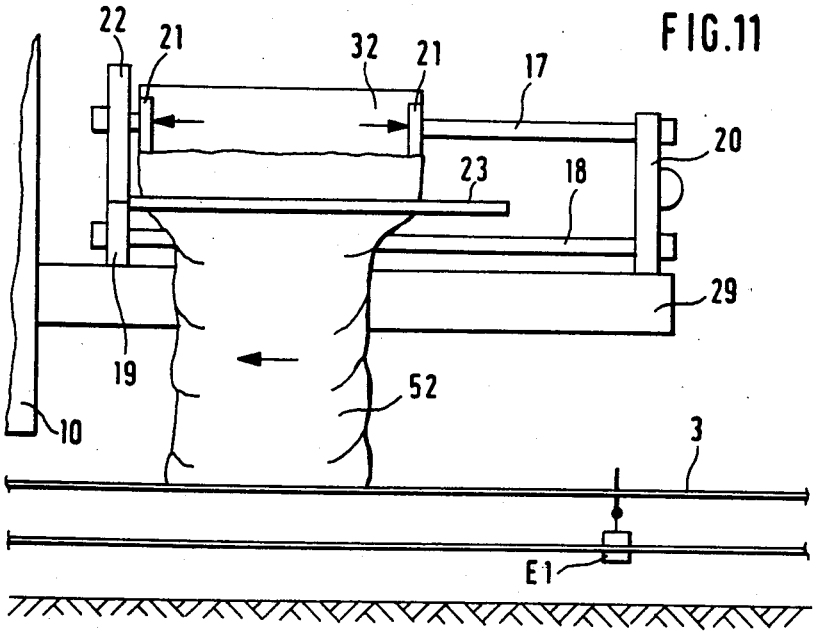
Figure 12:
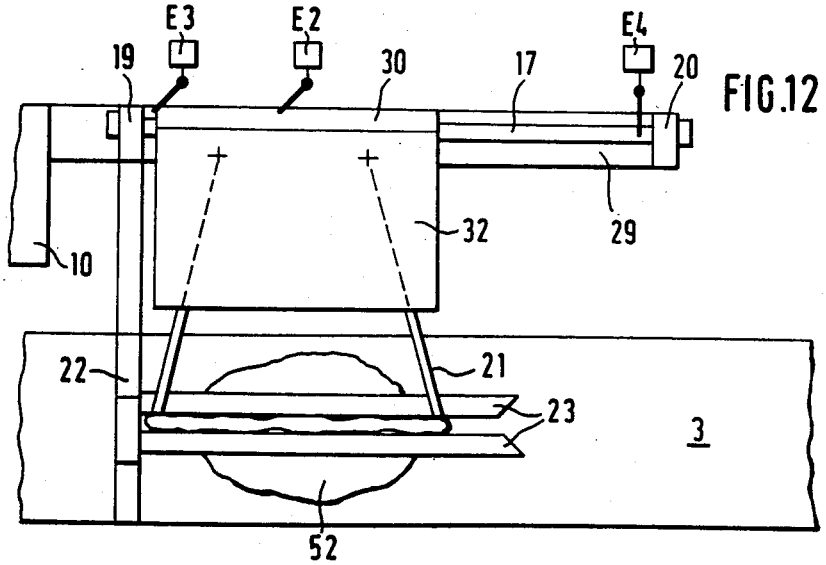
Figure 13:
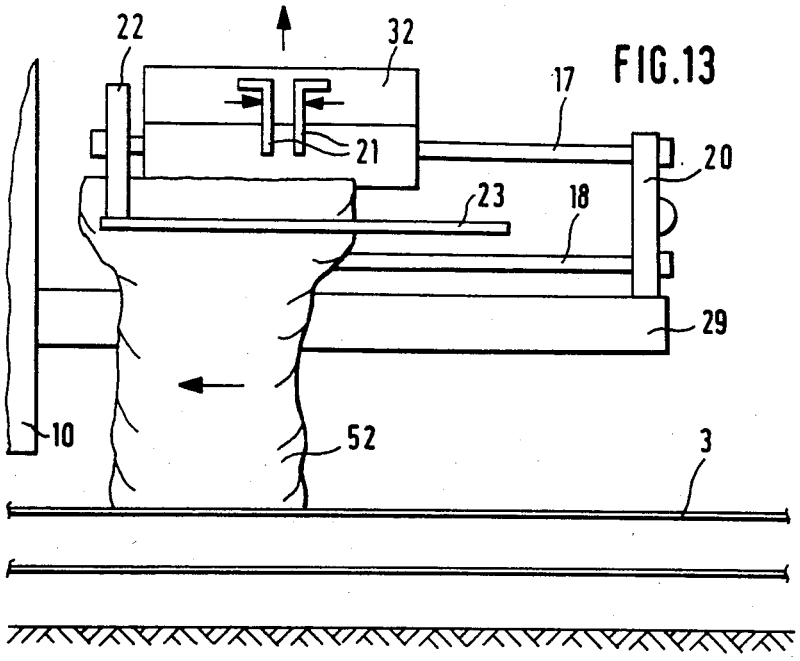
Figure 14:
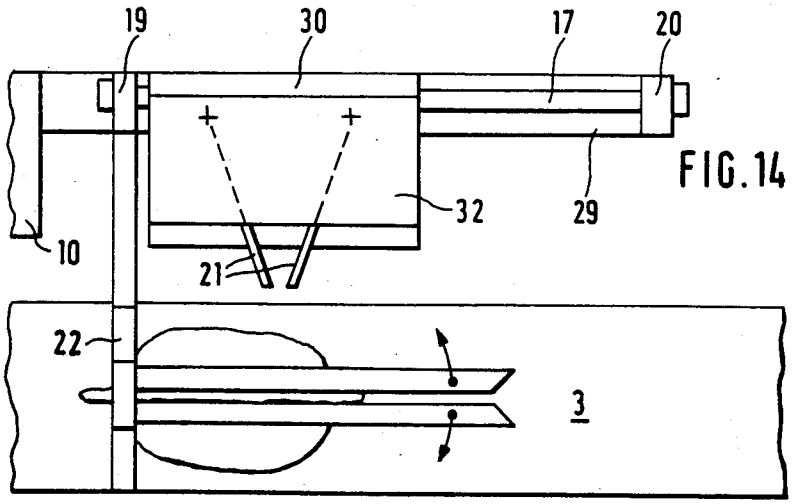

Explained in the following with the aid of FIGS. 7 to 14 will be the function of the plant described for bagging bulk products such as flour and the like, with FIG. 7, 9, 11 and 13 being views of the spreading apparatus illustrated in simplified fashion, and FIG. 8, 10, 12 and 14 views from above onto the figures preceding them. A bag 52 being filled from a conveying track 3 with constant speed in the conveying direction (arrow 4), and open at the top, reaches, in FIG. 7 and 8, the spreading apparatus. At this point in time, the cylinder piston units 23' hold the closing bars 23 in their spreading position so that the bag 52 can travel in between without difficulty. Here, the slide 30 assumes its end position away from the column 9, in which the piston rod of the cylinder piston unit 34 is extended and the bearing housing 32, with the spreading fingers 21, is pivoted upwardly. In doing this, the piston rod of the cylinder piston unit 43 is retracted, so that the spreading fingers 21 assume the position adjacent to one another. At this point in time, the bag 52 actuates the sensor of a switch E 1, whereby the motor 47 and the cylinder piston units 34 and 43 are actuated such that the slide 30 moves along with the conveying track 3 at the same speed, and the bearing housing 32, with the spreading fingers 21, is lowered and the spreading fingers 21 are moved apart for exerting the spreading movement. In so doing, the ends of the spreading fingers 21 dip (plunge) into the open bag end. Toward the end of the spreading movement (FIG. 9 and 10), the slide 30 actuates a switch E 2 that activates the cylinder piston units 23' for a closing movement. The closing bars 23 apply themselves, at the top end of the bag, against the bag walls held in parallel alignment by the spreading fingers 21 and form a narrow guide slot in which the top end of the bag can slide along further with adjacently lying bag walls. When the slide 30 reaches its end position lying next to the column 9 (FIG. 11 to 14), it actuates the switch E 3 which actuates the cylinder piston unit 43 and moves the spreading fingers 21 toward each other. It further activates the cylinder piston units 23' and 34 such that the closure bars 23 are spread apart and the spreading fingers, with the bearing housing 32, are pivoted out upwardly from the bag 52. In the same fashion, switch E 4 reverses the motor 47, which moves the slide 30 back against the vertical strut 20, where it actuates the switch E 4 that shuts off the motor 47 (FIG. 7 and 8).

The spreading apparatus is now again ready to spread the top, open end of the next arriving bag.

The bag 62 leaving the closing bars 23 arrives, with its open end, between the folding bars 14 and 15, so that it (end) will be turned down and folded. The thusly turned-folded top bag end next passes through the stitching mechanism 12, stitching parallel to the fold. In place of the stitching mechanism, also capable of being provided is a gluing station, whereby the top end of the bag is sealed with glue.

If, in the case of changing the bag height, the conveying track 3 is raised at the receiving location, then, by actuation of the motor 28, the column 9 can be pivoted until the folding edge of the lower folding bar 14, respectively the longitudinal guides 17 and 18, are aligned parallel to the conveying track 3 whereby is guaranteed a straight folding and stitching of the bag end.

I claim:

1. Apparatus for automatically closing filled, open-topped bags, which comprises:

conveyor means for continuously advancing the filled bags in generally upright orientation at a predetermined speed along a predetermined input path from a receiving end to a discharge end;

a pair of pivotal depending fingers mounted for reciprocal movement along said conveyor means in a direction generally parallel to the input path;

means for effecting reciprocal movement of said fingers substantially synchronous with movement of each successive bag along a predetermined portion of the input path;

means mounted for movement with said fingers for effecting pivotal movement of said fingers about an axis generally parallel to the input path into and out of the top of each successive bag responsive to positioning of the bags along the input path;

means mounted for movement with said fingers for effecting pivotal movement of said fingers about an upright axis generally transverse to the input path into and out of a spread position engaged with the top end of each successive bag responsive to positioning of the bags along the input path;

means for closing the spread top ends of each successive bag advanced by said conveyor means along the input path;

means for folding the closed, top end of each successive bag advanced by said conveyor along the input path; and means for securing the folded, closed top end of each successive bag advanced by said conveyor along the input path.

2. The apparatus of claim 1, wherein said fingers are actuated into spread position at a speed relatively slower than the speed of bags along the input path.

3. The apparatus of claim 1, wherein said securing means comprises a stitcher.

4. The apparatus of claim 1, further including a suction line mounted for movement with said fingers.

5. The apparatus of claim 1, further including:

a generally vertical column located along said conveyor means between the receiving and discharge ends; and;

a jacket mounted for adjustable vertical positioning along said column, said depending fingers, said closing means, said folding means, and said securing means being commonly supported on said jacket.

6. The apparatus according to claim 5, wherein said column is rigidly secured to said conveyor means.

7. The apparatus according to claim 5, further including:

means for supporting said column for adjustable pivotal movement about a second generally transverse axis.

8. Apparatus for automatically closing filled, open-topped bags, which comprises:

conveyor means for continuously advancing filled bags in generally vertical orientation along a predetermined longitudinal input path from a receiving end to a discharge end;

means for supporting the discharge end of said conveyor means for pivotal movement about a first generally transverse axis;

means for supporting the receiving end of said conveyor means for adjustable vertical movement;

a generally vertical column located along said conveyor means between the receiving and discharge ends;

a pair of pivotal depending fingers mounted on said column for reciprocal movement along said conveyor means in a direction generally parallel to the input path;

means for selectively effecting reciprocal movement of said fingers substantially synchronous with movement of each successive bag along a predetermined portion of the input path;

means for selectively effecting pivotal movement of said fingers about an axis generally parallel to the input path into and out of the top of each successive bag responsive to positioning of the bags along the input path;

means for selectively effecting pivotal movement of said fingers about an upright axis generally transverse to the input path into and out of a spread position engaged with the top of each successive bag responsive to positioning of the bags along the input path;

means mounted on said column for selectively engaging and closing the spread, top end of each successive bag advanced by said conveyor means along the input path; and means mounted on said column for securing the closed top end of each successive bag advanced by said conveyor along the input path.

9. A method of automatically closing and securing filled bags on a continuous basis, comprising the steps of:

providing an endless belt conveyor having opposite receiving and discharge ends;

supporting the discharge end of the conveyor for pivotal movement about a generally transverse axis;

supporting the receiving end of the conveyor for adjustable vertical movement;

successively depositing filled bags in generally vertical orientation onto the recieving end of the conveyor for continuous advancement along a predetermined input path;

mounting a pair of depending pivotal fingers for reciprocal movement along a path generally parallel to the input path of the bags;

selectively pivoting the fingers downwardly about an axis generally parallel to the input path into the open top end of a bag while moving the fingers along the parallel path at a speed substantially synchronous with the speed of the moving bag along the input path;

selectively pivoting the moving fingers outwardly about an upright axis generally transverse to the input path to spread the top of the moving bag in a direction generally parallel to the input path;

holding the spread, open top end of the moving bag in closed position;

folding the closed top end of the moving bag;

securing the folded, closed top end of the moving bag;

discharging the closed bag from the discharge end of the conveyor; and repositioning the fingers for engagement with the next successive bag.

10. The method of claim 9, wherein the fingers open outwardly at a predetermined speed relatively slower than the speed of the bags.

* * * * *